US006955071B2

(12) United States Patent
Klinkhammer et al.

(10) Patent No.: US 6,955,071 B2
(45) Date of Patent: Oct. 18, 2005

(54) MECHANICAL BENDING APPARATUS

(75) Inventors: Marc Klinkhammer, Ditzingen (DE); Wolfgang Laib, Besigheim (DE); Peter Bytow, Simmozheim (DE)

(73) Assignee: Trumpf Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 10/669,039

(22) Filed: Sep. 23, 2003

(65) Prior Publication Data

US 2004/0194531 A1 Oct. 7, 2004

(30) Foreign Application Priority Data

Sep. 23, 2002 (EP) ..... 02021107

(51) Int. Cl.[7] ..... B21D 5/04
(52) U.S. Cl. ..... 72/319
(58) Field of Search ..... 72/319, 320, 446, 72/444

(56) References Cited

U.S. PATENT DOCUMENTS 929,818 A * 8/1909 Benedek ..... 72/319
4,112,731 A * 9/1978 Anderson et al. ..... 72/320
5,067,340 A * 11/1991 MacGregor ..... 72/389.5
5,630,336 A * 5/1997 Jorgenson ..... 72/319
5,927,135 A * 7/1999 Kutschker ..... 72/319

FOREIGN PATENT DOCUMENTS

| | | |
|---|---|---|
| DE | 4222357 | 5/1980 |
| DE | 196 40 124 | 7/1992 |
| GB | 2032308 | 9/1996 |
| WO | WO96/24445 | 8/1996 |

* cited by examiner

*Primary Examiner*—Daniel C. Crane

(57) ABSTRACT

A mechanical bending device (8) for bending flat workpieces (6) has at least one bending tool assembly (9) which includes at least one tool part that can move by means of a bending tool drive (27). When acted on by the tool part that moves, the workpiece can be bent along a bending line (11). The movable tool part is comprised of a multiplicity of adjacent segments disposed in the direction of the bending line (11), which segments can be selectively connected to the bending tool drive (27) to provide the desired operational length for the bending tool assembly. The machine tool incorporating the mechanical bending device can also include a mechanical cutting device so that workpiece parts can be both bent and machine cut in the same machine tool.

16 Claims, 11 Drawing Sheets

MECHANICAL BENDING APPARATUS

BACKGROUND OF THE INVENTION

The invention concerns a mechanical bending apparatus for bending flat workpieces, especially sheet metal, with at least one bending tool assembly which has at least one part that can be moved by means of a drive, whereby the workpiece can be bent along a bending line when acted on by the moving tool part, and the moveable tool part is comprised of adjacent segments in the direction of the bending line.

The generic state of the art is illustrated and described in DE 196 40 124 A1. This prior publication discloses a bending machine with a swiveling bending tool. A bending cheek of the swiveling bending tool is provided with a bending cheek tool, which is in turn composed of tool segments arranged in a row in the direction of the bending line. Individual tool segments can be moved back and forth between "on" and "off" positions. If the tool segments are in the "on" position, they act on the workpiece when the bending cheek segments swivel and thus help bend it. When they go into the "off" position, the tool segments pass by the workpiece without deforming it. The bending cheek is always swiveling with all tool segments, i.e., those in both the "on" and "off" positions.

It is an object of the present invention to provide a novel bending tool assembly which is rapidly adjustable for changing the effective length of the bend to be produced.

It is also an object to provide such an assembly which is readily fabricated and easily operated.

SUMMARY OF THE INVENTION

It has now been found that the foregoing and related objects may be readily attained in a mechanical bending apparatus for bending flat workpieces (6) including at least one bending tool assembly (9, 9*a*) which has at least one tool part that can be moved by means of a bending tool drive (27, 27*a*) to bend the workpiece along a bending line (11) by being acted on by the movable tool part. The movable tool part is comprised of a multiplicity of adjacent segments disposed along the direction of the bending line (11), and each operatively connectable to the bending tool drive (27, 27A) to permit ready variation of the number of segments so connected and thereby the operative length of the movable tool part.

The bending tool (9, 9*a*) is a swivelable bending tool with a movable tool part in the form of a bending cheek (14, 14*a*) that can swivel on a swivel axis (21) running in the direction of the bending line (11). The bending cheek (14, 14*a*) is comprised of a multiplicity of segments (17, 17*a*), at least some of which can be selectively connected to the bending tool drive (27, 27*a*) and can be swiveled on the swivel axis (21) when the drive connection is made to produce the bending action on the workpiece. At least some segments (17, 17*a*) of the bending cheek (14, 14*a*) are two-arm swivelable levers with a bending arm (19, 19*a*) provided on one side of the swivel axis (21) for acting on the workpiece and bending it. A drive arm (20, 20*a*) is provided on the other side of the swivel axis (21) for selective connection to the bending tool drive (27, 27*a*).

Preferably, at least one swivelable lever can be engaged by a switching device (34) on the drive arm side in a recess (35) on a driver (36) of the bending drive (27*a*) or disengaged from that recess (35) whereby the connection between the swivelable lever and the bending drive (27*a*) is made in the engaged mode and is broken in the disengaged mode.

The tool assembly includes a control element (24) with a track (23) between at least some of the swivelable levers and the bending drive (27) and some swivelable levers are supported on the drive arm side on the track (23) of the control element (24). The swivelable levers being selectively connected to the bending tool drive on the bending tool drive side by a switching device. When the drive connection is made between the control element (24) and the bending tool drive (27), the swivelable lever is acted on by the track (23) of the control element (24) on the drive arm side and can thereby swivel about the swivel axis (21) to produce the bending action on the workpiece. The switching device for selectively connecting the control element (24) and the bending tool drive (27) has at least one coupling part (25) that can be selectively engaged and disengaged between the control element (24) and the bending tool drive (27). The connection between the control element (24) and the bending tool drive (27) is made when the coupling part (25) is engaged and broken with the coupling part (25) is disengaged.

As indicated, the bending tool assembly (9, 9*a*) is swivelable and includes a hold-down device (15) extending along the bending line (11) so that the workpiece can be acted upon in its transverse direction and can thereby be fixed between the hold-down device (15) and a workpiece support (16) on the side of the workpiece opposite the hold-down device (15). The hold-down device (15) is comprised of a multiplicity of adjacent segments (18) disposed along the direction of the bending line (11), and at least some of the segment can be selectively connected to a drive for the hold-down device (15). These segments can be moved into a position where they act on the workpiece by producing a drive connection to bend the workpiece with the segments (18) of the hold-down device (15) and segments (17, 17*a*) of the bending cheek (14, 14*a*) working together at the same time when the drive of the hold-down device (15) or the bending tool drive (27, 27*a*) are connected thereto. At least two swivelable bending tool assemblies (9) can be utilized, each of which has a bending cheek (14) that can swivel, with at least some segments (17) of the bending cheek (14) being selectively connectable to the bending tool drive (27) and a hold-down device (15). The bending cheek (14) of one bending tool assembly and the hold-down device (15) of the other bending tool assembly (9) are arranged on the same side of the workpiece. On one side of the workpiece (6), the hold-down device (15) has a drive (30), and the bending tool drive (27) of the hold-down device (15) of the other bending tool assembly (9) have at least one common drive element.

The bending apparatus can be included in a machine tool for bending panels on a flat workpieces (6) which includes at least one mechanical cutting device (39) for machine cutting bendable panels in the workpiece, and at least one bending tool assembly (9, 9*a*) as described hereinbefore so that a control device for the machine can move the workpiece bet3ween a cutting station and a bending station.

In the present invention, one or more segments of the tool parts which are used are connected to the bending tool drive. When the workpiece is being formed, the only segments of the tool part that are moved are those that are actually needed to produce the desired bend. The other segments of the tool part can stay in the resting or "off" position. The right bending tool assembly is therefore available for each bending cycle and no tool change has is necessary.

The advantage of using the swiveling bending tool in the invention is that only the operative bending arm leaves its starting position when the workpiece is being tooled. The rest of the workpiece can stay in its initial position during the tooling process, unlike press braking, for example.

By having the hold-down divided into segments, those segments can be selectively connected to the drive of the hold-down device. The drive for the bending cheeks works together with the drive for the hold-down device when a workpiece is being tooled. Accordingly, the workpiece is acted upon by the hold-down device or segments of the hold-down device only in the area where the desired bend is to be made. Segments of the hold-down device arranged in other, roughly adjacent areas of the workpiece can be kept away from the workpiece. This is a special advantage if a bend must be made close to a bend that already exists on the workpiece. If the action of the workpiece with the segments of the hold-down device is limited to the area of the workpiece with the additional bend, then unwanted deformation of the already existing bend is prevented by the segments of the holding-down device.

By providing two bending tool assemblies on the machine, the operator can make bends in opposite directions on the workpiece. In the interest of a compact, inexpensive design, the drive of one bending assembly tool and the drive of the hold-down device of the other bending tool assembly have at least one drive element in common, on at least on one side of the workpiece.

BRIEF DESCRIPTION OF THE ATTACHED DRAWINGS

The present invention will be explained in greater detail below with the drawings illustrating embodiments of the invention wherein:

FIG. 1 schematically illustrates a bending machine for machine bending a workpiece of sheet metal;

FIGS. 2 to 6 are enlarged illustrations of the bending tool assembly at various points in the sequence of a bending cycle operating for a bending tool assembly that can be used on the bending machine in FIG. 1;

FIGS. 7*a* to 7*d* and 8*a* to 8*d* show the operation of the second type of bending tool which may be used on the bending machine in FIG. 1;

DETAILED DESCRIPTION OF THE ILLUSTRATED EMBODIMENTS

Figure 1:
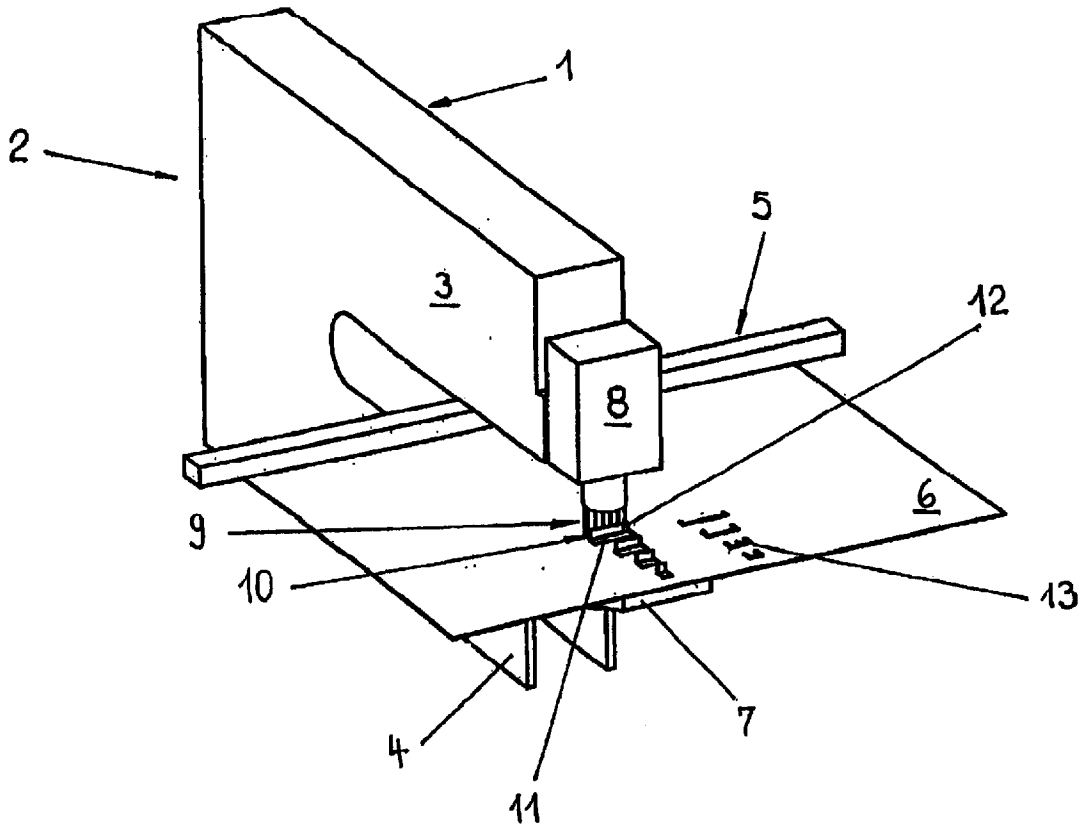

According to FIG. 1, a bending machine 1 has a C-shaped frame generally designated by the numeral 2 with a top arm 3 and a bottom arm 4. A conventional coordinate guide assembly generally designated by the numeral 5 is located in the throat of the bending machine 1 between the top arm 3 and the bottom arm 4 of the frame 2. A workpiece 6 to be machined in the form of a piece of sheet metal is held in the coordinate guide 5 by means of clamps (not shown), and can move with the corresponding movement of the coordinate guide assembly 5 in the horizontal plane of the sheet metal workpiece 6. When it is moved by the coordinate guide assembly 5, the sheet metal workpiece 6 rests on a workpiece support table 7 of the usual kind placed on top of the bottom arm 4.

The purpose of moving the sheet metal 6 with the coordinate guide assembly 5 is to position it opposite a mechanical bending device in a bending station 8 on the free end of the top arm 3. At the bending station 8, bends 10 of different lengths are made along the bending lines 11 with a bending tool generally designated by the numeral 9. The workpiece 6 has been previously processed to produce a series of panels 12 which are cut free on three sides of the flat sheet metal workpiece 6 before the sheet metal workpiece 6 is bent. Panels 13 still lying in the plane of the sheet metal 6 are also shown in FIG. 1. The folding of one of these panels 13 along a bending line 11 will be described below.

FIGS. 2 to 6 show the bending tool 9 as a swiveling bending tool with a bending cheek 14, a hold-down device 15 and a workpiece support 16. The bending cheek 14 is composed of five segments 17, and the hold-down device 15 is composed of five segments 18. Both the segments 17 of the bending cheek 14 and the segments 18 of the hold-down device 15 are aligned in a row in the direction of the bending line 11 of the bending cheek 14 work with those of the hold-down device 15.

The segments 17 of the bending cheek 14 are designed as swiveling levers, and each has a bending arm 19 and a drive arm 20. They are mounted so they can swivel on a swivel axis 21 on a bending cheek holder 22 at bending station 8. The drive arms 20 are supported with their free ends on a control path 23 which is provided on the control element 24. The control elements 24 can move in a straight line relative to the bending cheek holder 22. The control elements 24 can be connected to the piston 26 of a bending drive 27 by couplings 25. An individual coupling 25 is assigned to each control element 24. The couplings 25 can be engaged or disengaged by means of regulating devices (not shown), individually between the control elements 24 and the piston 26 of the bending drive 27.

Alternately, the control elements 24 and the piston 26 of the bending drive 27 can also be coupled by a coupling that can be moved in the direction of the swivel axis 21 between the control elements 24 and the piston 26 and whose length is dimensioned so that it can be arranged between one or more, or maximally all, control elements 24 on one hand, and the piston 26 on the other hand.

It is also possible to provide a shaft-like component for coupling the control elements 24 and the piston 26. The shaft has an axial direction which runs parallel to the swivel axis 21 and which has shaft sections one after another in that direction that are assigned to different control elements 24 and in the circumferential direction of the shaft, radial projections staggered relative to one another, whereby, depending on the rotational setting of the shaft to its axis, a different number of shaft sections is effective, and so a different number of control elements 24 is connected to the piston 26 by the radial shaft projections to control the number of segments 17 which are simultaneously actuated.

The factors for the hold-down device 15 are like those on the bending cheek 14. A coupling 28 is assigned to each segment 18 of the hold-down device 15. By means of a setting device (not shown), the couplings 28 can be engaged or disengaged individually between the segments 18 of the hold-down device 15 and the piston 29 of the drive 30 of the hold-down device 15. The segments 18 of the hold-down device 15 can move linearly in the direction of movement of the piston 29 on a hold-down device carrier 31. Corresponding to couplings 25, couplings 28 can be replaced by structurally different components to produce a drive connection between the piston 29 of the drive 30 of the hold-down device 15 and the segments 18 of the hold-down device 15.

Figure 2:
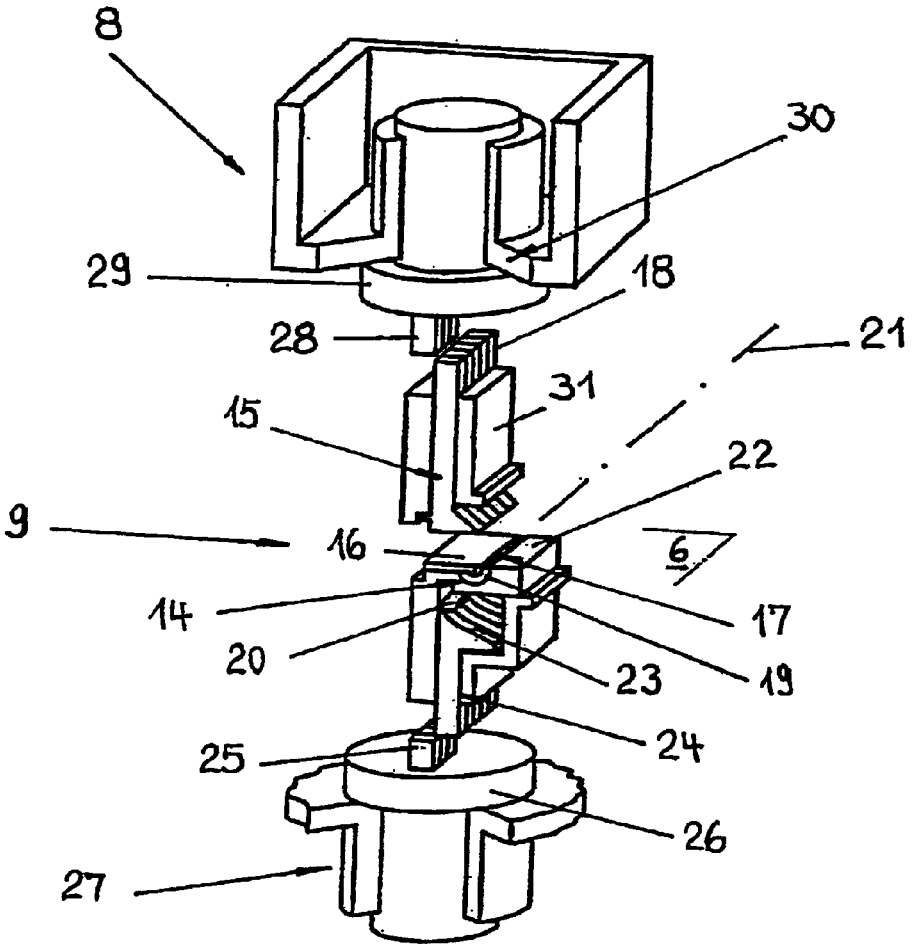
Figure 11A:
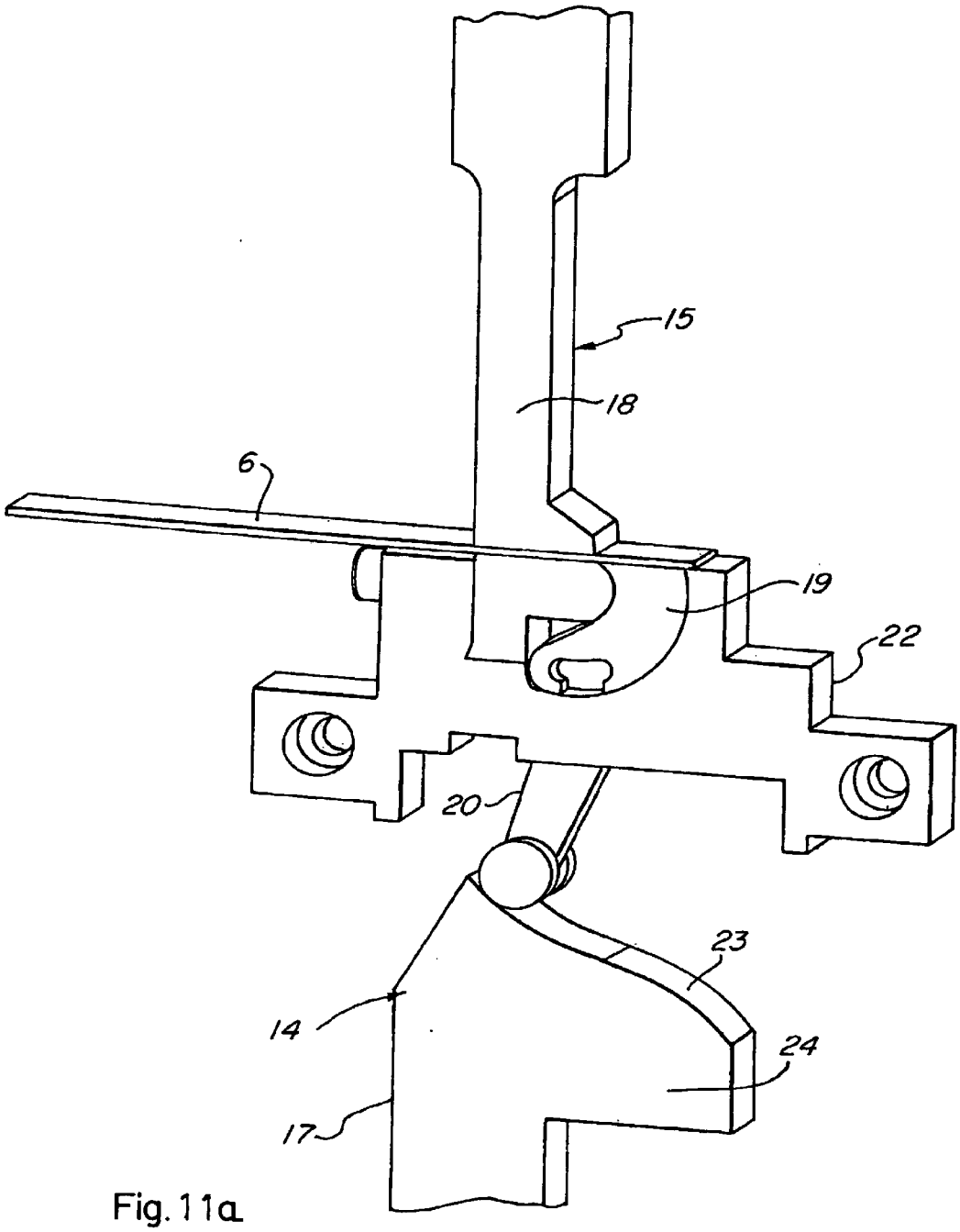
FIGS. 11*a*–11*d* diagrammatically illustrate the operation of the tool components in the embodiment of FIGS. 2–6.
Figure 11B:
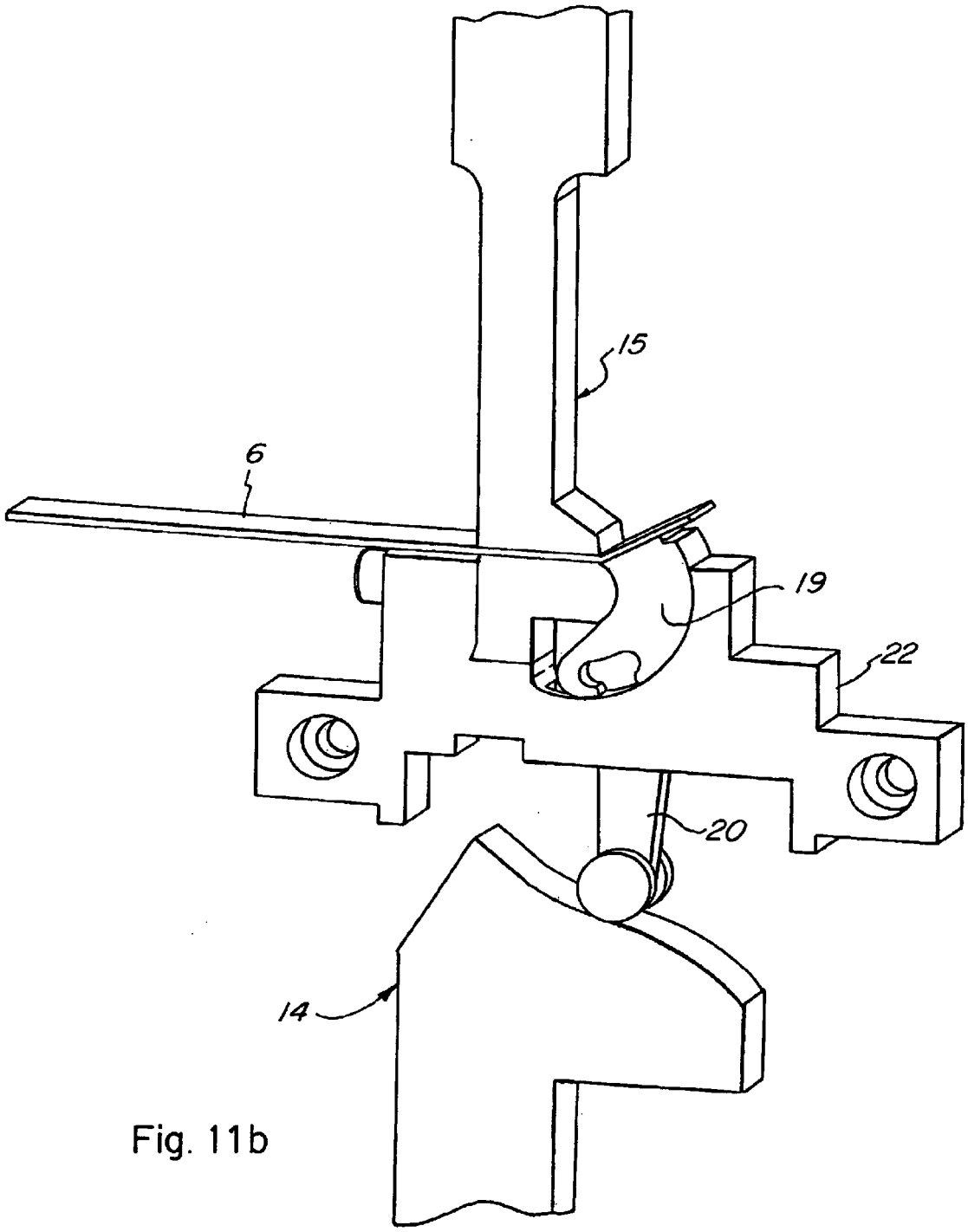
Figure 11C:
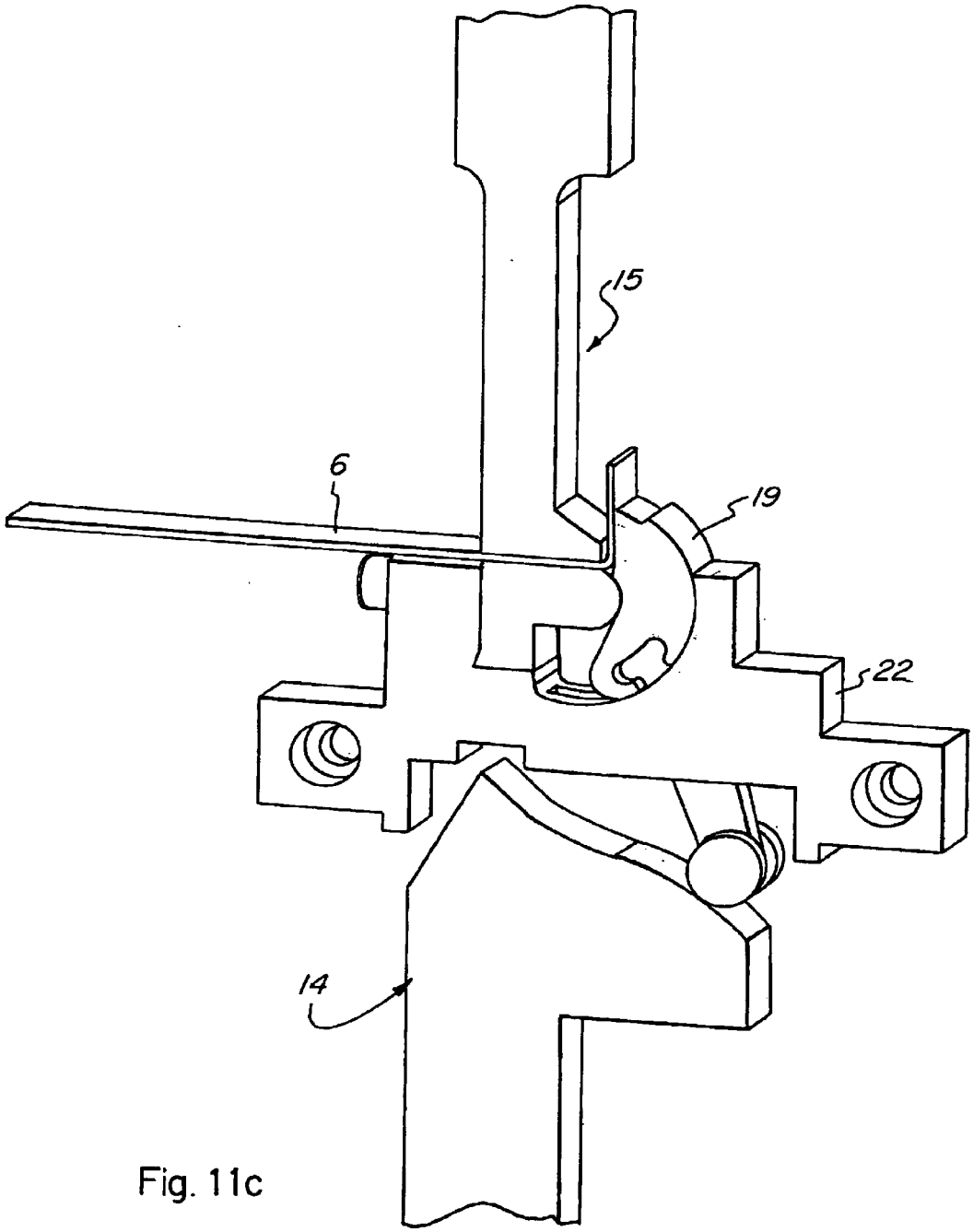
Figure 11D:
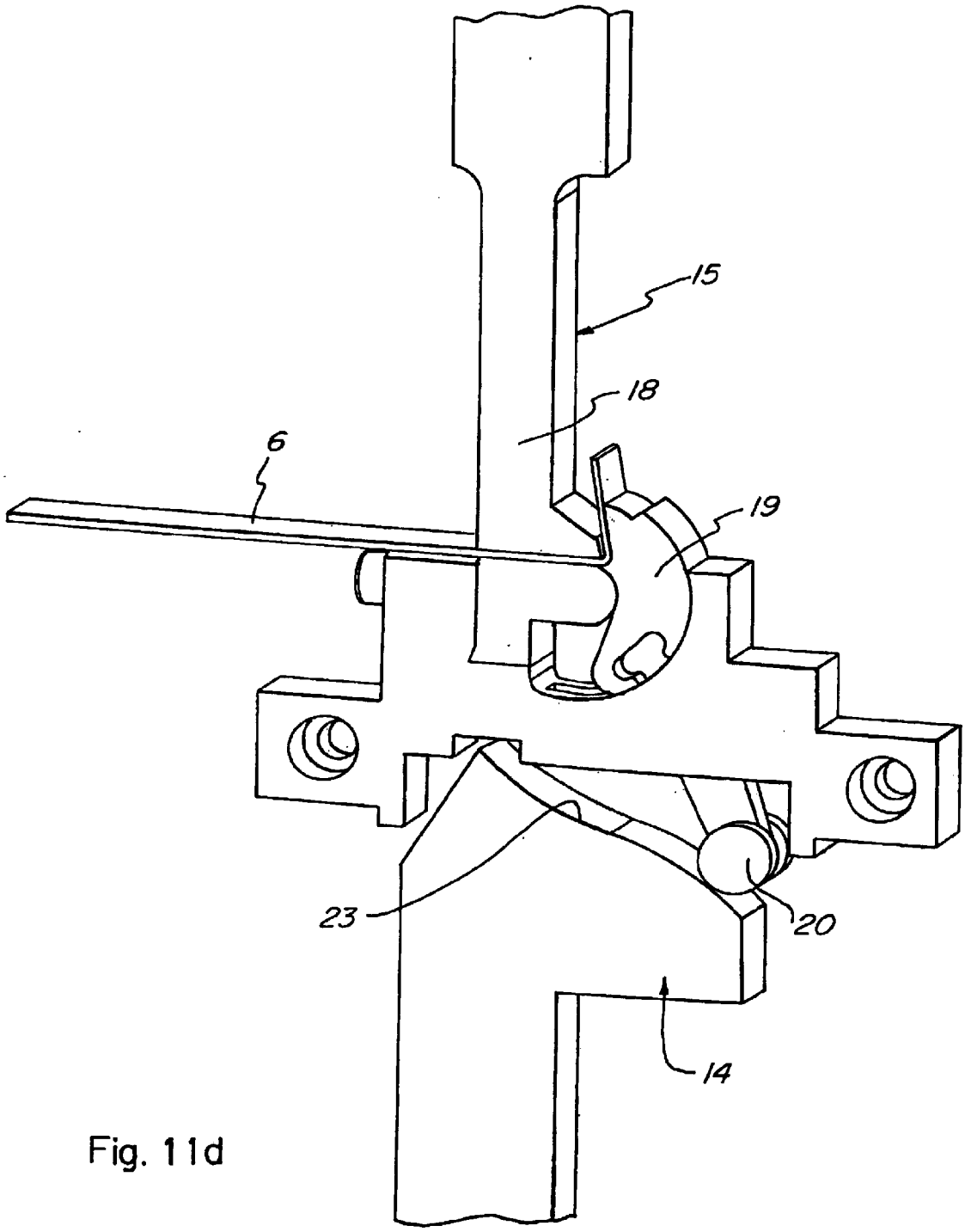

The initial situation before the sheet metal workpiece 6 is bent as shown in FIGS. 2 and 11*a*. The sheet metal workpiece 6 shown in dashes in FIG. 2 lies on the workpiece support 16. The bending cheek 14 and the selected bending cheek segments 17 are in their starting position. The hold-down device 15 and the segments 18 of the hold-down device 15 are positioned away from the sheet metal workpiece 6. The couplings 25, 28 are engaged. There is therefore no drive connection between the segments 17 of the bending cheek 14 and the bending drive 27 and no drive connection between the segments 18 of the hold-down device 15 and the drive 30 of the hold-down device 15.

To prepare for the bending process, a number of couplings 25, 28 consistent with the length of the bend to be made is engaged between the piston 26 of the bending drive 27 and the control elements 24, and between the segments 18 of the hold-down device 15 and the piston 29 of the drive 30 of the hold-down device 15.

Figure 3:
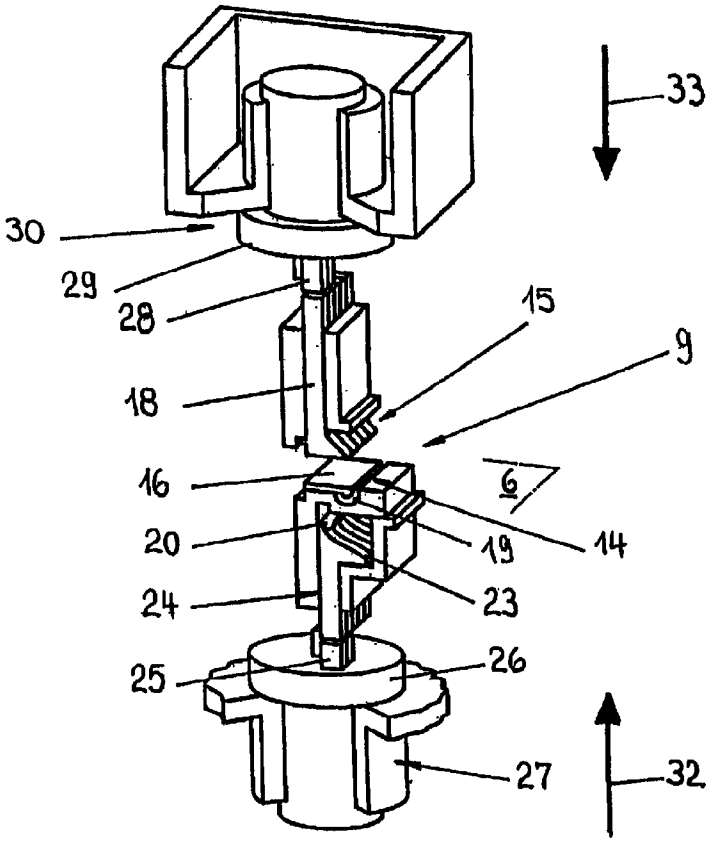
Figure 6:
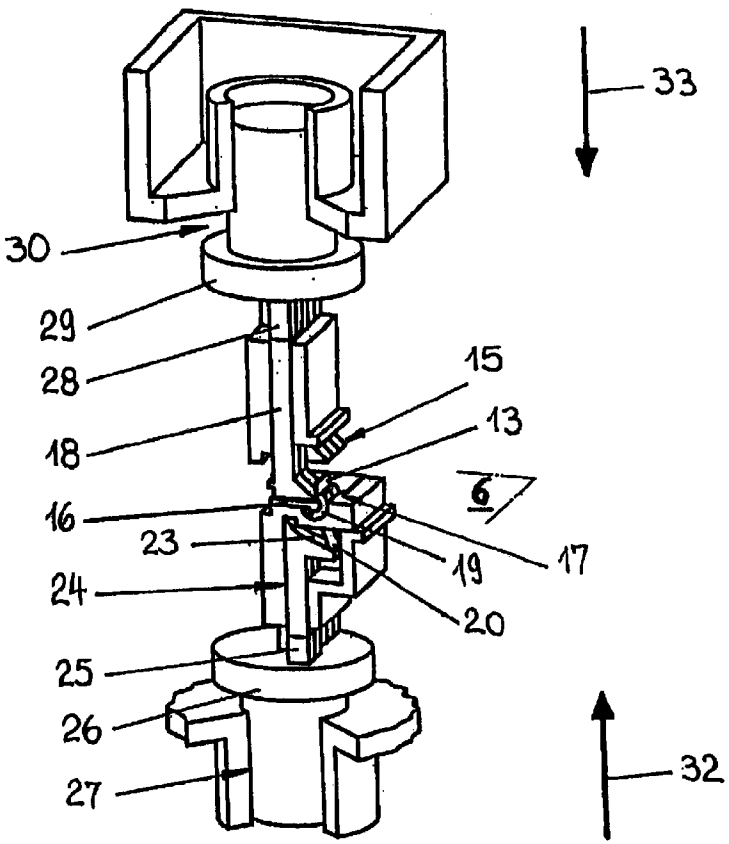

In the example shown, two couplings 25, 28 are taken from their "off" position in FIG. 2 into their "on" position in FIG. 3. Now, if the piston 26 of the bending drive 27 and the piston 29 of the drive of the hold-down device 15 are moved in the direction of arrows 32, 33, the two couplings 25 engaged come to bear on the two assigned control elements 24 and the two couplings 28 engaged come to lie on the two accompanying segments 18 of the hold-down device 15. Thus, the two segments 18 of the hold-down device 15 are connected to the drive 30 of the hold-down device 15, and the two control elements 24 and with them the two accompanying segments 17 of the bending cheek 14 are connected to the bending drive 27. The operating mode is shown in FIG. 4.

Figure 5:
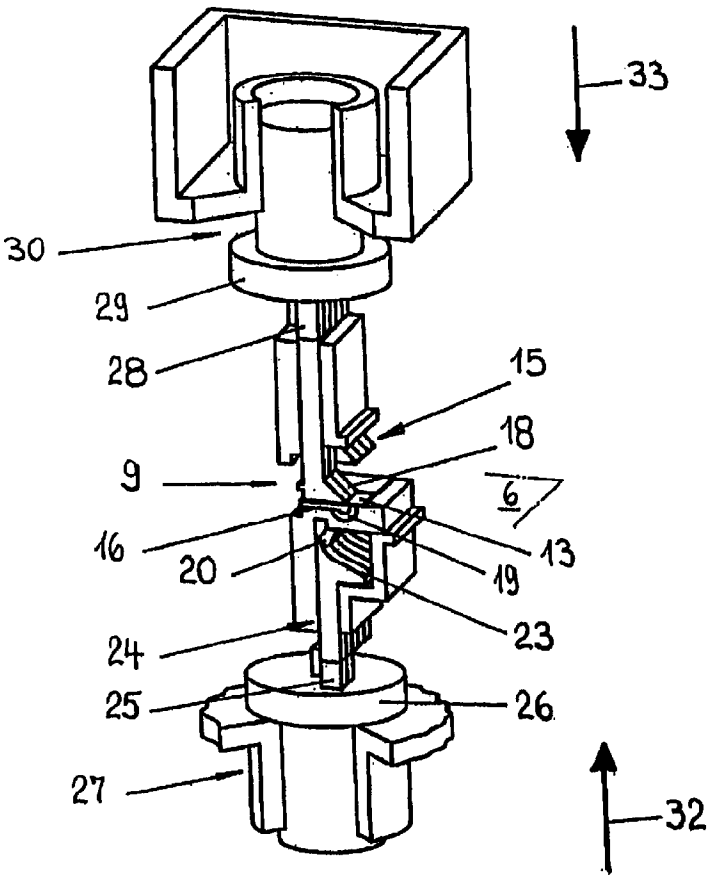
Figure 8A:
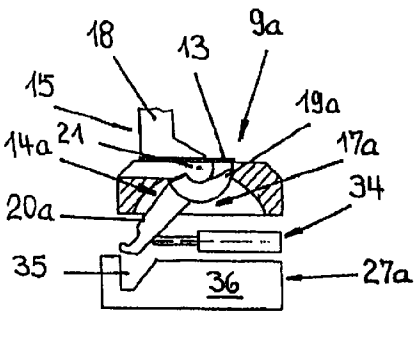
Figure 8B:
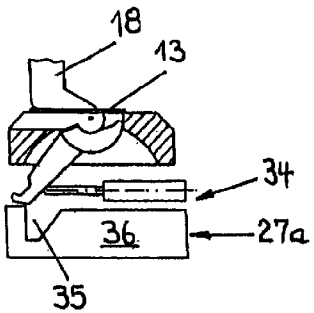
Figure 8C:
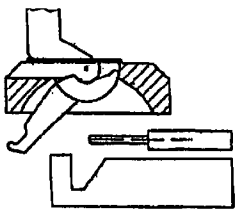
Figure 8D:
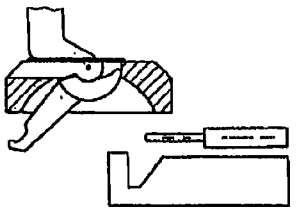
Figure 7A:
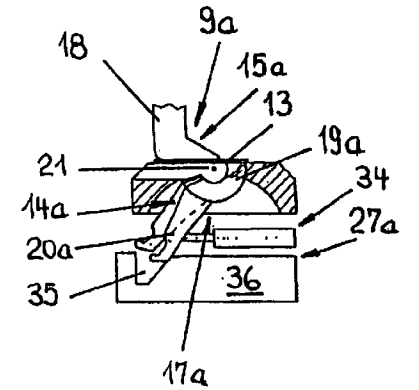
Figure 7B:
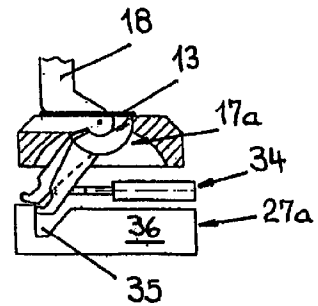
Figure 7C:
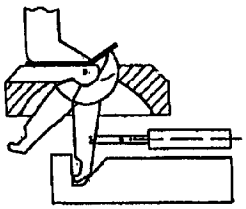
Figure 7D:
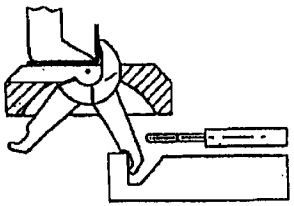

Starting from these conditions, if the drive 30 of the hold-down device 15 is activated, the segments 18 of the hold-down device 15 previously activated, i.e., connected to the drive 30 of the hold-down device 15 drop down onto the sheet metal workpiece 6. As a result of the positioning of the sheet metal workpiece 6 in the bending station 8, the activated segments 18 of the hold-down device 15 with their projecting ends come to lie in that area of the sheet metal workpiece 6 in which the flat panel 13 to be folded connects to the remaining sheet metal workpiece 6 as seen in FIG. 5. Because of the compressive pressure applied by the drive 30 of the hold-down device 15, the sheet metal workpiece 6 is secured against any movement between the working segments 18 of the hold-down device 15 and the workpiece support 16.

Figure 4:
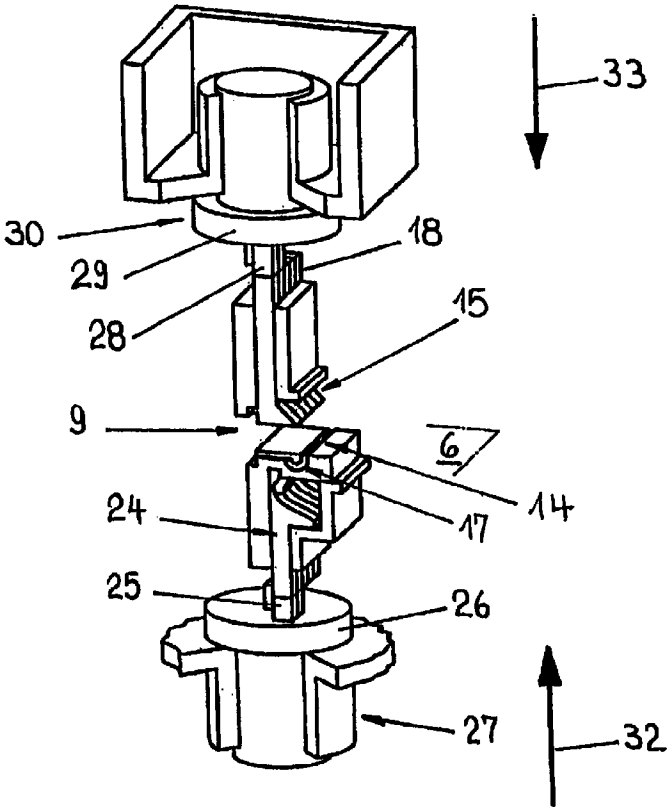

Now, if the piston 26 of the bending drive 27 leaves its position shown in FIGS. 4 and 5 and moves in the direction of arrow 32, the two activated control elements 24 are moved upwardly as seen in FIGS. 5 and 11*b*–11*d*. The accompanying segments 17 of the bending cheek 14 with their drive arms 20 thus slide along the tracks 23 of the two control elements 24. The two activated segments 17 of the bending cheek 14 consequently swivel on the swivel axis 21 and their bending arms 19 bend the panel 13 of the sheet metal workpiece 6 upwardly as shown in FIGS. 6 and 11*b*–*d*. Thus, the desired bend is made, and the bending tool 9 can be returned to its initial position in FIG. 2 by a return stroke of the pistons 26, 29 and corresponding return movement of the bending cheek segments 17 and segments 18 of the hold-down device 15 used for forming the sheet metal workpiece 6.

The bending tool 9*a* shown in FIGS. 7*a* to 7*d* and 8*a* to 8*d* differs from the bending tool 9 in FIGS. 2 to 6 basically in terms of the activation and operation of the bending cheek 14*a*. Thus, to activate and deactivate the swivel lever-type segments 17*a* of the bending cheek, a switching device 34 in the form of a regulating piston/cylinder is used. Thus each segment 17*a* of the bending cheek 14*a* has its own regulating device 34 assigned to it.

Segments 17*a* of the bending cheek 14*a* that are to be used in the subsequent machine operation are pushed into a recess 35 on a driver 36 of a bending drive 27*a* by the switching device 34 on one drive arm 20*a*. If the driver 36 is then pushed out of its starting position shown in FIG. 7*a* into its end position in FIG. 7*d*, it moves the drive arm 20*a* or the bending cheek segment or segments 17*a* with it. As a result, the segments 17*a* of the bending cheeks 14*a* swivel on their swivel axis 21 and deform the sheet metal workpiece 6 to the desired extent by means of the bending arm 19*a*. Segments 17*a* of the bending cheek 14*a* that are not used when the sheet metal workpiece 6 is bent are pushed out of the recess 35 on the driver 36 of the bending drive 27*a* by the respective switching device 34 or kept in the disengaged position. As shown in FIGS. 8*a* to 8*d*, the driver 36 is then pushed horizontally without the disengaged segments of the bending cheek 14*a* swiveling on the axis 21 to deform the sheet metal workpiece 6.

Figure 9:
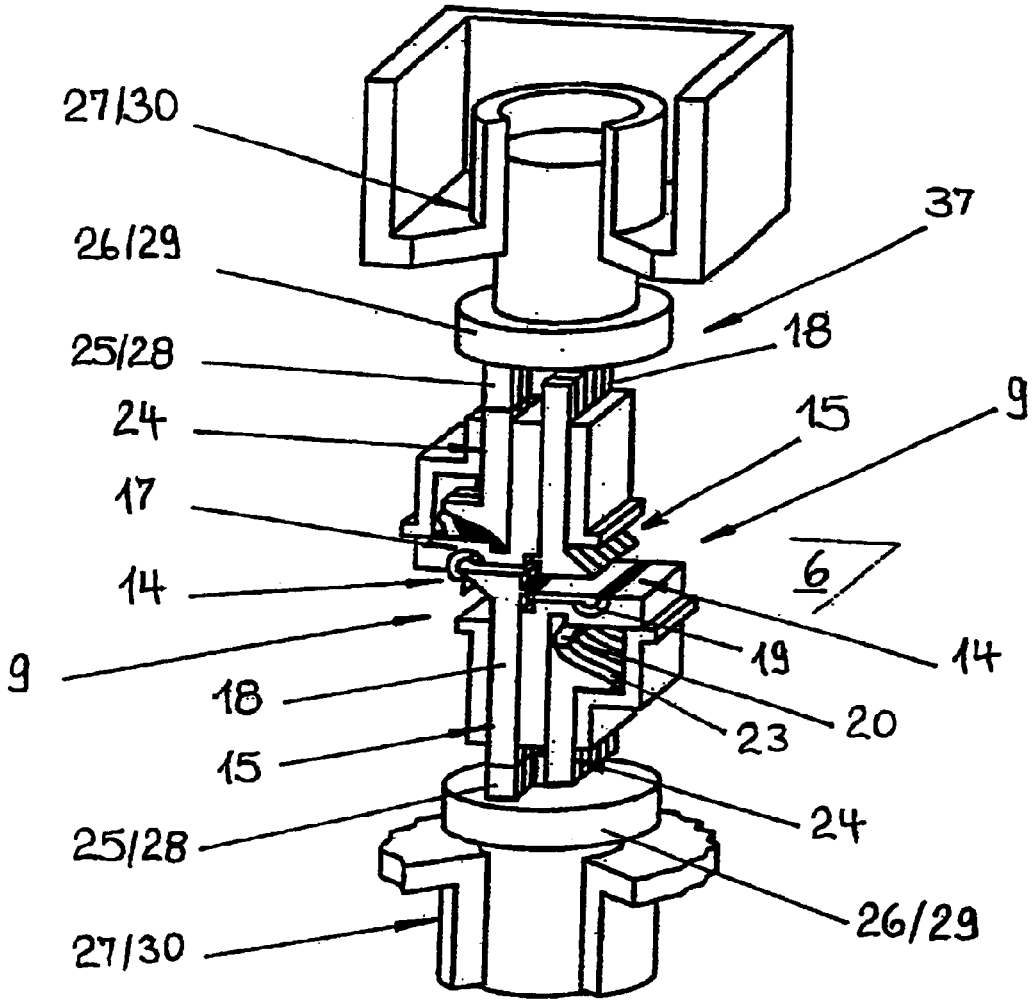
FIG. 9 shows a double tool assembly that can be used on the bending machine in FIG. 1.

A double tool 37 shown in FIG. 9 and includes two bending tool assemblies 9 that correspond to one another in design and function and are disposed 180° from one another. On one and the same side of the sheet of metal 6 being machined therefore are a hold-down device 15 of one bending tool assembly 9 and a bending cheek 14 of the other bending tool assembly 9. Because of this design, folds can be made in opposite directions on the bending tool assemblies 9. The panel of the sheet metal workpiece 6 folded under is shown in FIG. 9.

Couplings 25, 28 can be used on both sides of the sheet metal workpiece 6 optionally to activate a bending cheek 14 or to activate a hold-down device 15. Depending on which bending tool part is activated, a hydraulic drive works as a bending drive 27 with piston 26 or as the drive of a hold-down device 15 with piston 29.

Figure 10:
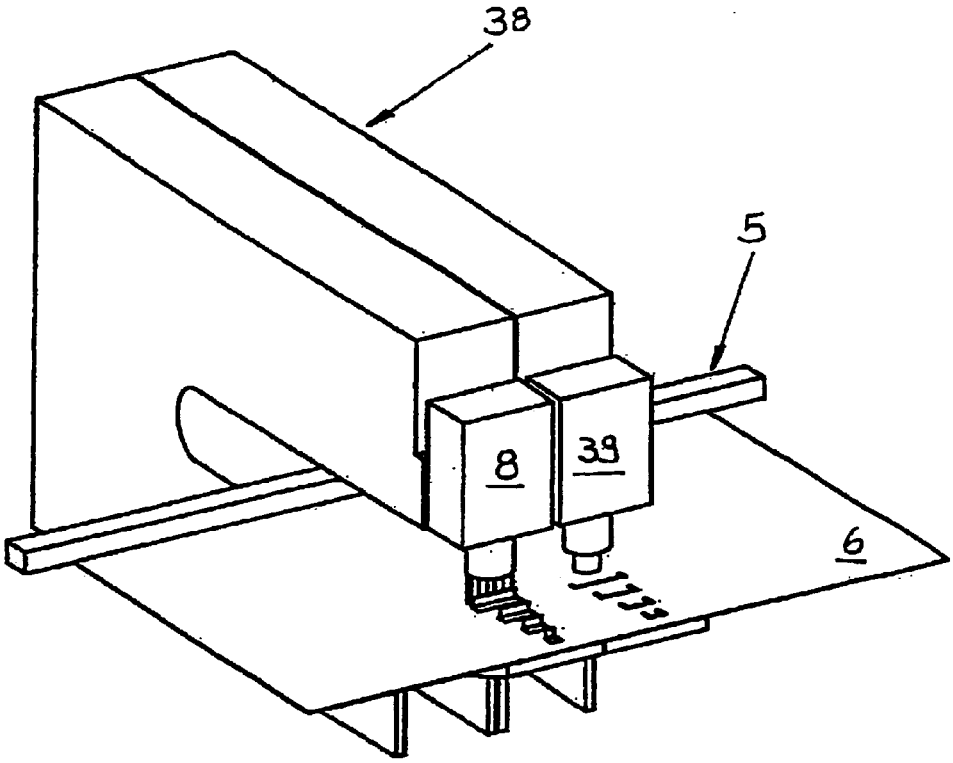
FIG. 10 shows a mechanical arrangement for machining sheet metal with a separate bending and cutting stations.

In FIG. 10, the bending station 8 is integrated into a machine tool 38 for processing a sheet metal workpiece 6 and it also includes a mechanical cutting device 39 for machine cutting the sheet metal workpiece 6. The cutting device 39 is a punch in the example shown. Other conceivable examples are water, plasma and/or laser-cutting devices. With the cutting device 39, first the grooves on three sides are cut free to provide the panels on the flat sheet metal workpiece 6. Then, the sheet metal workpiece 6 is positioned by the coordinate guide 5 in the bending station 8 so that the flat panels can be bent as shown.

The machine functions are CNC-controlled on all the machine-tooling devices described above.

Thus, it can be seen from the foregoing detailed description and attached drawings that the bending tool assembly of the present invention can be readily adjusted for bending different lengths of the workpiece and that the components can be readily fabricated and assembled.

Having thus described the invention, what is claimed is:

1. A mechanical bending apparatus for bending flat workpieces (6) including at least one beading tool assembly (9, 9*a*) which has at least one tool part that can be moved by means of a selectable bending tool drive (27, 27*a*) to bend the workpiece along a bending line (11) by being acted on by the movable tool part, said movable tool part comprising a multiplicity of adjacent segments disposed along the direction of the bending line (11), and each operatively connectable to the bending drive (27, 27A) to permit ready variation of the number of segments so connected and thereby the operative length of the movable tool part, said bending tool (9, 9*a*) being a swivelable bending tool with a movable tool part in the form of a bending cheek (14, 14*a*) that can swivel on a swivel axis (21) running in the direction of the bending line (11), said bending cheek (14, 14*a*) being comprised of a multiplicity of segments (17, 17*a*), at least some of which can be selectively connected to the selectable bending tool drive (27, 27*a*) and can be swiveled on the swivel axis (21) when the drive connection is selectively made to produce the bending action on the workpiece.

2. The mechanical bending apparatus in accordance with claim 1 wherein at least some segments (17, 17*a*) of the bending cheek (14, 14*a*) are two-arm swivelable levers with a bending arm (19, 19*a*) provided on one side of the swivel axis (21) for acting on the workpiece and bending it, and with a drive arm (20, 20*a*) provided on the other side of the swivel axis (21) for selective connection to the bending tool drive (27, 27*a*).

3. The mechanical bending apparatus in accordance with claim 2 wherein at least one swivelable lever can be engaged by a switching device (34) on the drive arm side in a recess (35) on a driver (36) of the bending drive (27*a*) or disengaged from that recess (35), whereby the connection between the swivelable lever and the bending drive (27*a*) is made in the engaged mode and is broken in the disengaged mode.

4. The mechanical bending apparatus in accordance with claim 2 wherein there is included a control element (24) with a track (23) between at least some of said swivelable levers and the bending drive (27) and some swivelable levers are supported on the drive ann side on the track (23) of the control element (24), said swivelable levers being selectively connected to the bending drive on the bending tool drive side by a switching device, whereby, when the drive connection is made between the control element (24) and the bending tool drive (27), the swivelable lever is acted on by the track (23) of die control element (24) on the drive arm side and can thereby swivel about the swivel axis (21) to produce the bending action on the workpiece.

5. The mechanical bending apparatus in accordance with claim 4 wherein the switching device for selectively connecting the control element (24) and the bending tool drive (27) has at least one coupling part (25) that can be selectively engaged and disengaged between the control element (24) and the bending tool drive (27), whereby the connection between the control element (24) and the bending tool drive (27) is made when the coupling part (25) is engaged and broken when the coupling part (25) is disengaged.

6. The mechanical bending apparatus in accordance with claim 1 wherein the bending tool assembly (9, 9*a*) is swivelable and includes a hold-down device (15) extending along the bending line (11), so that the workpiece can be acted upon in its transverse direction and can thereby be fixed between the hold-down device (15) and a workpiece support (16) on the side of the workplece opposite the hold-down device (15), said hold-down device (15) being comprised of a multiplicity of adjacent segments (18) disposed along the direction of the bending line (11), at least some of which can be selectively connected to a drive fix the hold-dawn device (15) and can be moved into a position where they act on the workpiece by producing a drive connection to bend the workpiece with the segments (18) of the hold-down device (15) and segments (17, 17*a*) of the bending check (14, 14*a*) working together at the same time when the drive of the hold-down device (15) or the bending tool drive (27, 27*a*) are connected thereto.

7. The mechanical bending apparatus in accordance with claim 1 wherein there are at least two swivelable bending tool assemblies (9), each of which has a bending cheek (14) that can swivel, with at least some segments (17) of the bending cheek (14) being selectively connectable to the bendizig tool drive (27) and a hold-down device (15), whereby the bending cheek (14) of one bending tool assembly and the hold-down device (15) of the other bending tool assembly (9) are arranged on the same side of the workpiece.

8. The mechanical bending assembly in accordance with claim 7 wherein on at least on one side of the workpiece (6), the hold-down device (15) has a drive (30), and the bending tool drive (27) of the hold-down device (15) of die other bending tool assembly (9) have at least one common drive element.

9. A machine tool for bending panels in flat workpieces (6), including:

(a) at least one mechanical cutting device (39) for machine cutting bendable panels in the workpiece; and (b) at least one bending tool assembly (9, 9*a*) including at least one tool part that can be moved by means of a selectable bending tool drive (27, 27*a*), to bend the workpiece along a bending line (11) by being acted on by the movable tool part, said movable tool part comprising a multiplicity of adjacent segments disposed along the direction of the bending line (11), and each operatively connectable to the bending drive (27, 27A) to permit ready variation of the number of segments so connected and thereby the operative length of the movable tool part, said bending tool (9, 9*a*) being a swivelable bending tool with a movable tool part in the farm of a bending cheek (14, 14*a*) that can swivel on a swivel axis (21) running in the direction of the bending line (11), said bending check (14, 14*a*) being comprised of a multiplicity of segments (17, 17*a*), at least some of which can be selectively connected to the selectable bending tool drive (27, 27*a*) and can be swiveled on the swivel axis (21) when the drive connection is selectively made to produce the bending action on the workpiece.

10. A machine tool for bending panels on a flat workpieces (6) in accordance with claim 9 wherein at least some segments (17, 17*a*) of the bending cheek (14, 14*a*) are two-arm swivelable levers with a bending arm (19, 19*a*) provided on one side of the swivel axis (21) for acting on the workpiece and bending it, and with a drive arm (20, 20*a*) provided on the other side of the swivel axis (21) for selective connection to the bending tool drive (27, 27*a*).

11. A machine tool for bending panels on a flat workpieces (6) in accordance with claim 10 wherein at least one swivelable lever can be engaged by a switching device (34) on the drive arm side in a recess (35) on a driver (36) of the bending drive (27*a*) or disengaged from that recess (35), whereby the connection between the swivelable lever and the bending drive (27*a*) is made in the engaged mode and is broken in the disengaged mode.

12. A machine tool for bending panels on a flat workpieces (6) in accordance with claim 10 wherein there is included a control element (24) with a track (23) between at least some of said swivelable levers and the bending drive (27) and some swivelable levers are supported on the drive arm side on the track (23) of the control element (24), said swivelable levers being selectively connected to the bending drive on the bending tool drive side by a switching device, whereby, when the drive connection is made between the control element (24) and the bending tool drive (27), the swivelable lever is acted an by the track (23) of the control element (24) on the drive arm side and can thereby swivel about the swivel axis (21) to produce the bending action on the workpiece.

13. A machine tool for bending panels on a flat workpieces (6) in accordance with claim 12 wherein the switching device for selectively connecting the control element (24) and the bending tool drive (27) has at least one coupling part (25) that can be selectively engaged and disengaged between the control element (24) and the bending tool drive (27), whereby the connection between the control element (24) and the bending tool drive (27) is made when the coupling part (25) is engaged and broken when the coupling part (25) is disengaged.

14. A machine tool for bending panels on a flat workpieces (6) in accordance with claim 9 wherein the bending tool assembly (9, 9*a*) is swivelable and includes a hold-down device (15) extending along die bending line (11), so that the workplece can be acted upon in its transverse direction and can thereby be fixed between the hold-down device (15) and a workpiece support (16) on the side of the workpicce opposite the hold-down device (15), said hold-down device (15) being comprised of a multiplicity of adjacent segments (18) disposed along the direction of the bending line (11), at least some of which can be selectively connected to a drive for the hold-down device (15) and can be moved into a position where they act on the workpiece by producing a drive connection to bend the workpiece with the segments (18) of the hold-down device (15) and segments (17, 17*a*) of the bending cheek (14, 14*a*) working together at the same tune when the drive of the hold-down device (15) or the bending tool drive (27, 27*a*) are connected thereto.

15. A machine tool for bending panels on a flat workpieces (6) in accordance with claim 9 wherein there are at least two swivelable bending tool assemblies (9), each of which has a bending cheek (14) that can swivel, with at least some segments (17) of the bending cheek (14) being selectively connectable to the bending tool drive (27) and a hold-down device (15), whereby the bending check (14) of one bending tool assembly and the hold-down device (15) of the other bending tool assembly (9) are arranged on the same side of the workpiece.

16. A machine tool for bending panels on a flat workpieces (6) in accordance with claim 15 wherein on at least on one side of the workpiece (6), the hold-down device (15) has a drive (30), arid the bending tool drive (27) of the hold-down device (15) of the other bending tool assembly (9) have at least one common drive element.

* * * * *

UNITED STATES PATENT AND TRADEMARK OFFICE

CERTIFICATE OF CORRECTION

PATENT NO. : 6,955,071 B2
DATED : October 18, 2005
INVENTOR(S) : Marc Klinkhammer et al.

It is certified that error appears in the above-identified patent and that said Letters Patent is hereby corrected as shown below:

Column 7,
Line 38, “die” should be -- the --;
Line 60, “fix” should be -- for --;

Column 8,
Line 6, “bendizig” should be -- bending --;
Line 14, “die” should be -- the --.

Signed and Sealed this

Seventeenth Day of January, 2006

JON W. DUDAS
*Director of the United States Patent and Trademark Office*